US008309019B2

(12) United States Patent
Chiesa et al.

(10) Patent No.: US 8,309,019 B2
(45) Date of Patent: Nov. 13, 2012

(54) POWDER METAL FORGING AND METHOD AND APPARATUS OF MANUFACTURE

(75) Inventors: Alfred J. Chiesa, Farmington Hills, MI (US); David E. Lenhart, Jr., Pomeroy, OH (US)

(73) Assignee: GKN Sinter Metals, LLC, Auburn Hills, MI (US)

( * ) Notice: Subject to any disclaimer, the term of this patent is extended or adjusted under 35 U.S.C. 154(b) by 576 days.

(21) Appl. No.: 12/526,888

(22) PCT Filed: Feb. 8, 2008

(86) PCT No.: PCT/US2008/053389

§ 371 (c)(1),
(2), (4) Date: Aug. 12, 2009

(87) PCT Pub. No.: WO2008/100811

PCT Pub. Date: Aug. 21, 2008

(65) Prior Publication Data

US 2010/0035077 A1 Feb. 11, 2010

Related U.S. Application Data

(60) Provisional application No. 60/900,893, filed on Feb. 12, 2007.

(51) Int. Cl.
*B22F 3/24* (2006.01)
*B21D 45/00* (2006.01)

(52) U.S. Cl. ..... 419/28; 72/344

(58) Field of Classification Search ..... 419/28; 72/344

See application file for complete search history.

(56) References Cited

U.S. PATENT DOCUMENTS

| | | | | |
|---|---|---|---|---|
| 3,694,127 | A | 9/1972 | Takahashi et al. | |
| 3,832,763 | A * | 9/1974 | Schober | 29/893.34 |
| 3,842,646 | A | 10/1974 | Kuhn | |
| 4,038,860 | A | 8/1977 | Kanamaru et al. | |
| 4,051,590 | A | 10/1977 | Halter et al. | |
| 4,165,243 | A | 8/1979 | Sarnes et al. | |
| 4,666,665 | A * | 5/1987 | Hornsby et al. | 419/48 |

(Continued)

FOREIGN PATENT DOCUMENTS

| | | |
|---|---|---|
| GB | 618009 | 2/1949 |
| WO | PCT/US2010/060066 | 12/2010 |

OTHER PUBLICATIONS

PCT International Search Report for PCT/US2010/060066, mailed Feb. 11, 2011.

(Continued)

*Primary Examiner* — Roy King
*Assistant Examiner* — Ngoclan T Mai
(74) *Attorney, Agent, or Firm* — Quarles & Brady LLP

(57) ABSTRACT

A method of forming a powder metal forging, including the steps of: forming a preform including a sintered powder metal composition; inserting the preform in a die set having a bottom die and a top die, the die set defining a forge form therewithin, the die set being in a closed position wherein the top die is contacting the bottom die; and compressing the preform in the forge form using an upper punch and a lower punch, the compressing step resulting in a formed part. The closed die set minimizes or eliminates flash in the formed part, particularly in the contoured surfaces, which allows the forging to be through hardened by direct quenching after the forging operation, without the need to remove hardened flash from these surfaces.

14 Claims, 6 Drawing Sheets

U.S. PATENT DOCUMENTS

| | | | |
|---|---|---|---|
| 4,712,411 | A | 12/1987 | Goodwin |
| 5,718,774 | A | 2/1998 | Tukamoto et al. |
| 6,630,101 | B2 | 10/2003 | Anderson et al. |
| 6,730,263 | B2 | 5/2004 | Ernst et al. |
| 2003/0049151 | A1 | 3/2003 | Wehler |
| 2003/0159284 | A1 | 8/2003 | Ohara et al. |
| 2007/0221005 | A1 | 9/2007 | Geiman |
| 2010/0083782 | A1 | 4/2010 | Cheisa |
| 2011/0000335 | A1 | 1/2011 | Chiesa |

OTHER PUBLICATIONS

The International Search Report and Written Opinion as mailed on Jun. 5, 2008 for International Patent Application PCT/US2008/053389.

PCT International Search Report for PCT/US07/87149 mailed Aug. 19, 2008.

PCT International Search Report for PCT/US08/58980 mailed Aug. 21, 2008.

* cited by examiner

POWDER METAL FORGING AND METHOD AND APPARATUS OF MANUFACTURE

CROSS-REFERENCE TO RELATED APPLICATIONS

The present application claims the benefit of U.S. Provisional Patent Application No. 60/900,893, filed Feb. 12, 2007, and the benefit of PCT International Application No. PCT/US2008/053389, filed on Feb. 8, 2008, both applications are incorporated herein by reference.

STATEMENT REGARDING FEDERALLY SPONSORED RESEARCH

Not Applicable.

BACKGROUND OF THE INVENTION

1. Field of the Invention

The present invention relates to powder metal forgings, and, more particularly, relates to minimum flash or flash-free/precision flash powder metal forgings.

2. Description of the Related Art

In the manufacture of powder metal forgings, such as an inner race of a constant velocity joint (CVJ), it is sometimes desirable to provide a through-hardened part directly from the forge press. This requires that the part be directly quenched after the part has been ejected from the forge tooling. In forging such a part, the upper die moves in a downward direction to the lower die to deform the billet, which forms the part. This results in flash forming on the sides of the part where the upper and lower dies meet, which is in an area of bearing races for an inner race of a CVJ. If the part is directly quenched, then the tool flash is in a hardened state. Although hard trimming, which is a method of shearing the flash from the part, is possible, it is not practical because the flash can exceed the hardness of the current trim tooling creating a potentially dangerous situation for the operators and can also negatively impact the quality of the product. That is, the part can break apart during trimming and fly out of the confines of the tooling. Also, the bearing races are precision surfaces and fairly intricate so that they are not very amenable in general to shearing.

A method of forging a CVJ inner race is known whereby a segmented die (6 die segments) is used to form the CVJ inner race using a traditional cold forging technique. However, this technique requires a machine to broach the spline and a relatively long carburization process. Further, there are six vertical witness lines on the part corresponding to the six die segments. Other disadvantages of this method are that it is a relatively complex and expensive tooling arrangement, with a relatively short die life.

What is needed in the art is a powder metal forging and method and apparatus of manufacture which produces a part with a minimum of flash, or no flash, particularly on precision surfaces, and which is compatible with direct quenching after the part has been ejected from the forge tooling.

SUMMARY OF THE INVENTION

The present invention discloses a powder metal forging and method and apparatus of manufacture which includes a closed die set, and also the powder metal preform, where the preform is forged in the closed die set to produce a minimum flash or flash-free/precision flash powder metal forging.

The invention comprises, in one form thereof, a method of forming a powder metal forging, including the steps of: forming a preform including a sintered powder metal composition; inserting the preform in a die set having a bottom die and a top die, the die set defining a forge form therewithin, the die set being in a closed position wherein the top die is contacting the bottom die; and compressing the preform in the forge form using an upper punch and a lower punch, the compressing step resulting in a formed part.

The invention comprises, in another form thereof, a preform for a powder metal forging, which includes a first end, a second end opposed to the first end, an outer contour connecting the first end and the second end, and an inner contour connecting the first end and the second end. The outer contour includes a plurality of longitudinal projections and a plurality of longitudinal depressions, each of the plurality of longitudinal projections being separated from another of the plurality of longitudinal projections by a corresponding one of the plurality of longitudinal depressions. The inner contour has a longitudinal keyway and a plurality of longitudinal splines. The preform includes a composition of sintered powder metal, where the composition has a form defined by the first end, the second end, the outer contour and the inner contour.

The invention comprises, in yet another form thereof, a flash free powder metal forging manufactured from a sintered powder metal preform in a forging process, which includes a first end, a second end opposed to the first end, an inner contour connecting the first end and the second end and an outer contour connecting the first end and the second end. The inner contour has a plurality of longitudinal splines. The outer contour includes a plurality of curvilinear longitudinal projections and a plurality of curvilinear longitudinal depressions. Each of the plurality of curvilinear longitudinal projections are separated from another of the plurality of curvilinear longitudinal projections by a corresponding one of the plurality of curvilinear longitudinal depressions. The outer contour is absent of flash from the forging process.

An advantage of the present invention is that it can be used to produce a minimum flash or flash-free/precision flash powder metal forging.

Another advantage of the present invention is that the preform is formed so that there is no buckling of the preform in the forging operation; particularly with longitudinal splines on an inside diameter of the preform.

Yet another advantage of the present invention is that it provides a minimum flash or flash-free/precision flash powder metal forging.

Yet another advantage of the present invention is that there is no material overlapping or folding during the forging operation.

Yet another advantage of the present invention is that it can be direct quenched, by oil submersion for example, immediately after the forging process.

Yet another advantage of the present invention is that it provides a cost effective way of manufacturing an inner race of a constant velocity joint.

Yet another advantage of the present invention is that it can be used with a preform of a relatively high density.

Yet another advantage of the present invention is that it can be used to manufacture complex flash free parts which eliminates or minimizes material waste.

Yet another advantage of the present invention is that it minimizes the time the part is in contact with the tooling, thereby reducing tooling costs over the lifecycle of the product.

Yet another advantage of the present invention is that it provides a cost effective way of manufacturing powder metal forgings.

The foregoing and other features and advantages of the invention appear in the detailed description which follows. In the description, reference is made to the accompanying drawings which illustrate a preferred embodiment of the invention.

DETAILED DESCRIPTION OF THE PREFERRED EMBODIMENT

Figure 1:
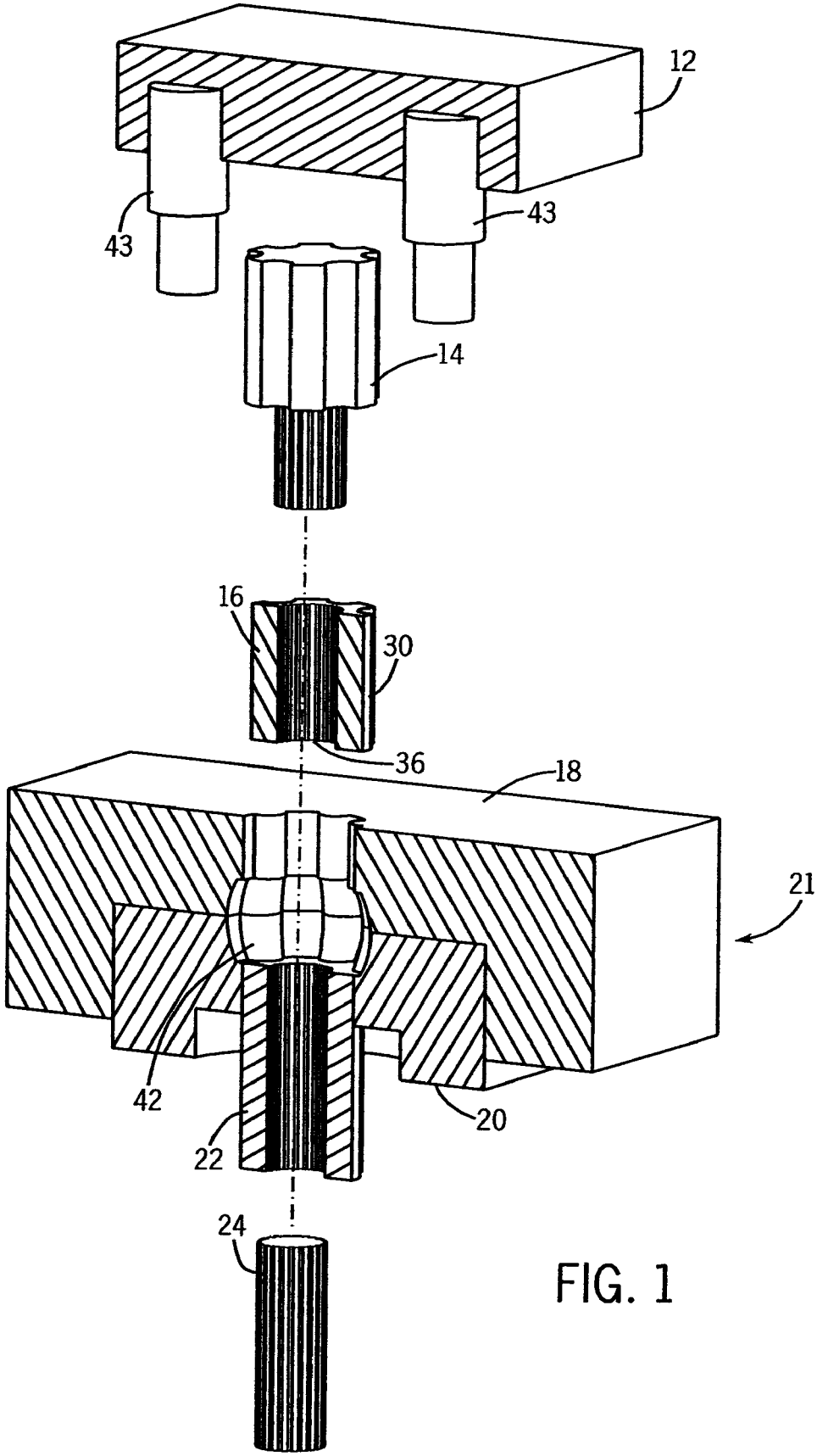
FIG. 1 is a partially exploded and cross-sectional view of an embodiment of a powder metal forging method and apparatus of manufacture according to the present invention.
Figure 6:
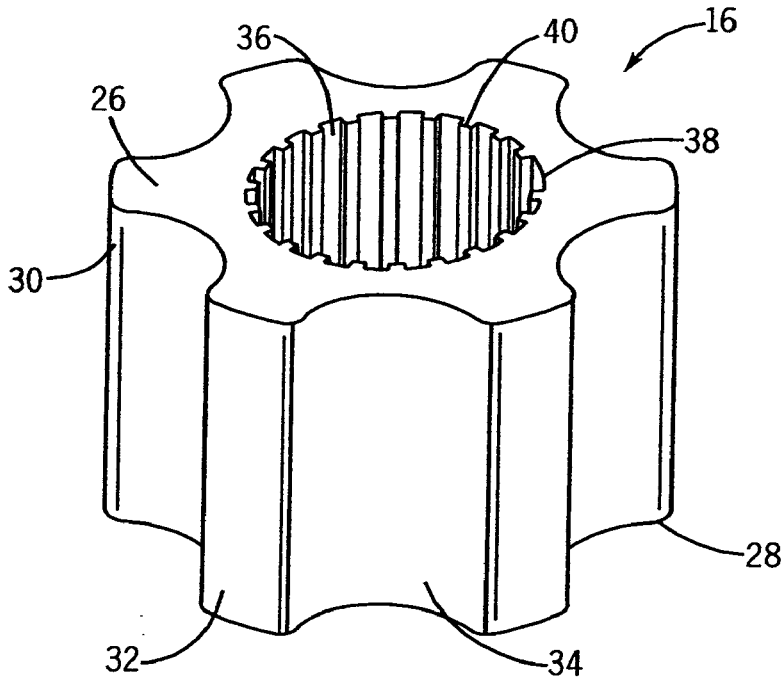
FIG. 6 is a perspective view of an embodiment of a preform according to the present invention.
Figure 7:
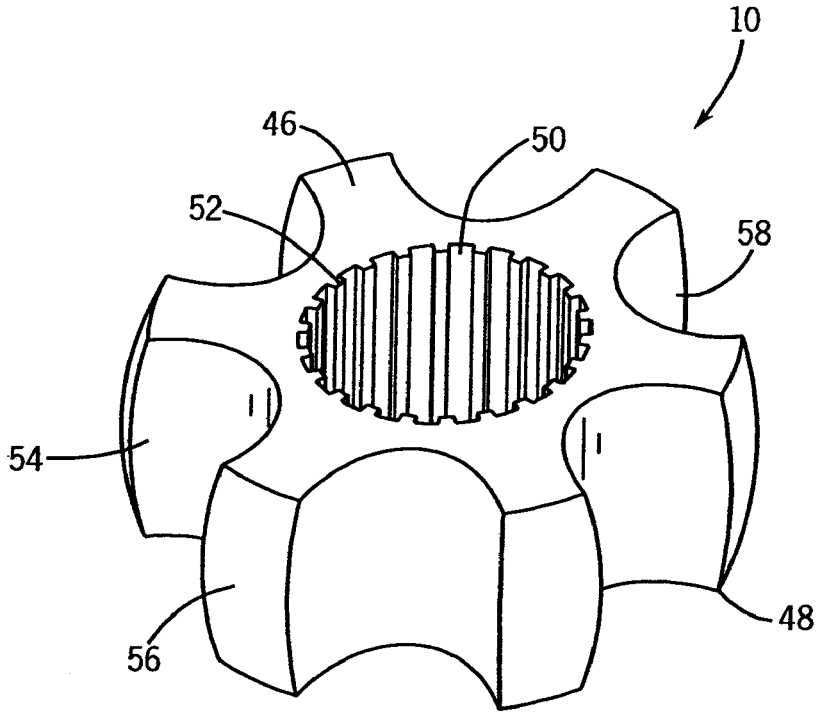
FIG. 7 is a perspective view of an embodiment of a forging according to the present invention.

Referring now to the drawings, and more particularly to FIGS. 1, 6 and 7, there is shown a method and apparatus of forming a powder metal forging 10, which can include a ram or hammer 12, an upper punch 14, a preform 16, an upper die 18 and a lower die 20 which comprises a die set 21, lower punch 22 and snag pin 24.

Referring more particularly to FIG. 6, preform 16 includes a powder metal composition which has been compacted and then sintered. The composition of the powder metal includes approximately between 0.40% and 2.00% of nickel, approximately between 0.50% and 0.65% of molybdenum, approximately between 0.10% and 0.35% of manganese, approximately between 0.12% and 0.80% of carbon, and balance iron. Preform 16 is a noncylindrical preform which includes a first end 26, a second end 28 opposed to first end 26 and an outer contour 30 connecting first end 26 and second end 28. Outer contour 30 includes a plurality of longitudinal projections 32 and a plurality of longitudinal depressions 34. Each of the longitudinal projections 32 are separated from another projection 32 by a corresponding longitudinal depression 34. An inner contour 36 connects first end 26 and second end 28, where inner contour 36 has a longitudinal keyway 38 and a plurality of longitudinal splines 40. Keyway 38 aids in the correct orientation of preform 16 in die set 21, whereas longitudinal splines 40 provide strength to preform 16, particularly during the forging process, which keeps the preform from buckling during forging. It can be advantageous for the preform to be of a relatively high density as this yields better properties in the forged part, although generally as the density of the material goes up the flowability goes down. Consequently of this additional strength added by longitudinal splines 40, preform 16 advantageously can have a density approximately between 6.85 g/cm$^3$ and 7.4 g/cm$^3$, and more particularly, a density in a range of approximately between 6.85 g/cm$^3$ and 7.0 g/cm$^3$. Projections 32 and depressions 34 extend from first end 26 to second end 28.

Figure 2:
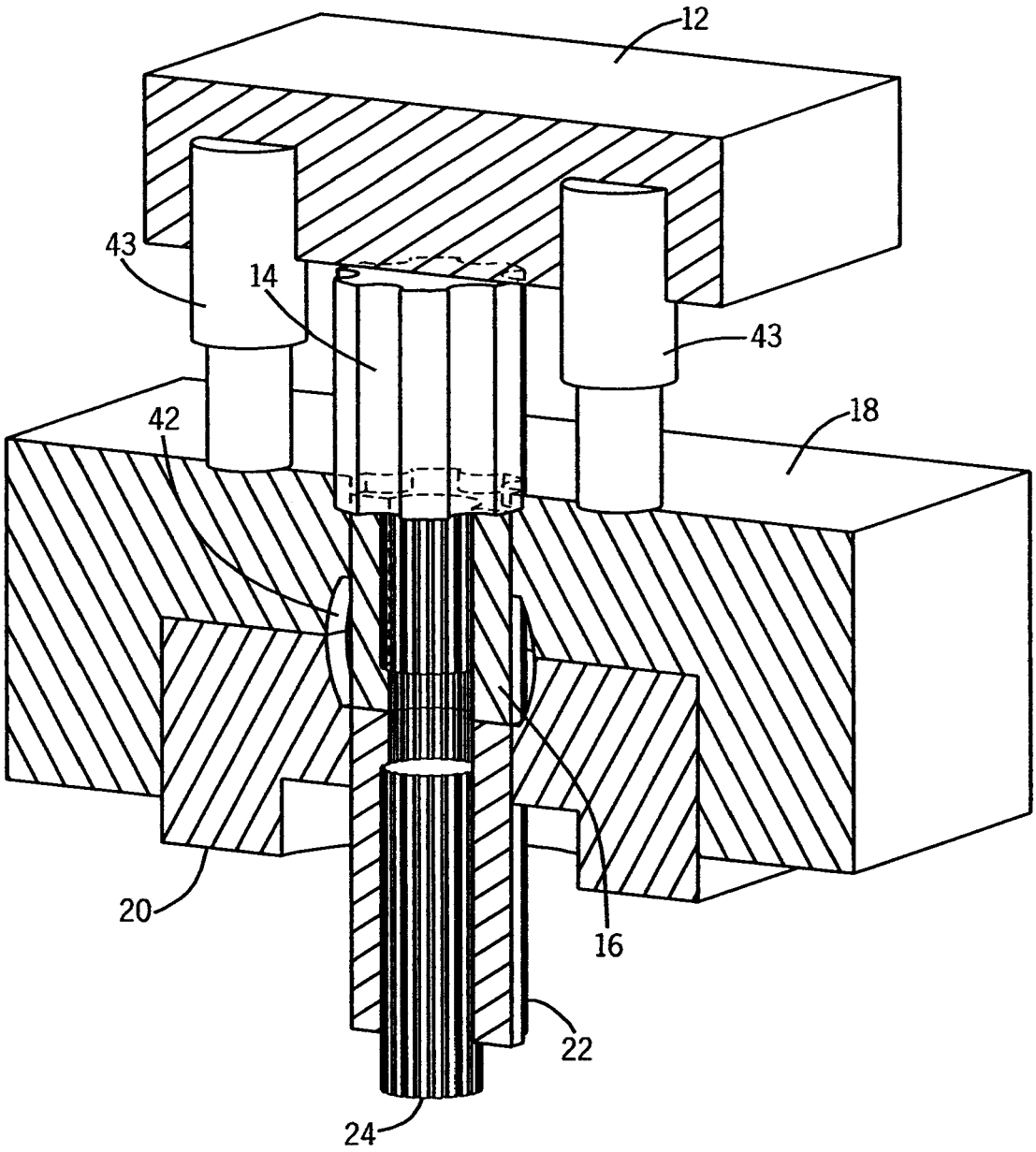
FIG. 2 is a partially cross-sectional view of the method and apparatus of FIG. 1 illustrating the preform in the die set and the upper punch just contacting the preform.
Figure 3:
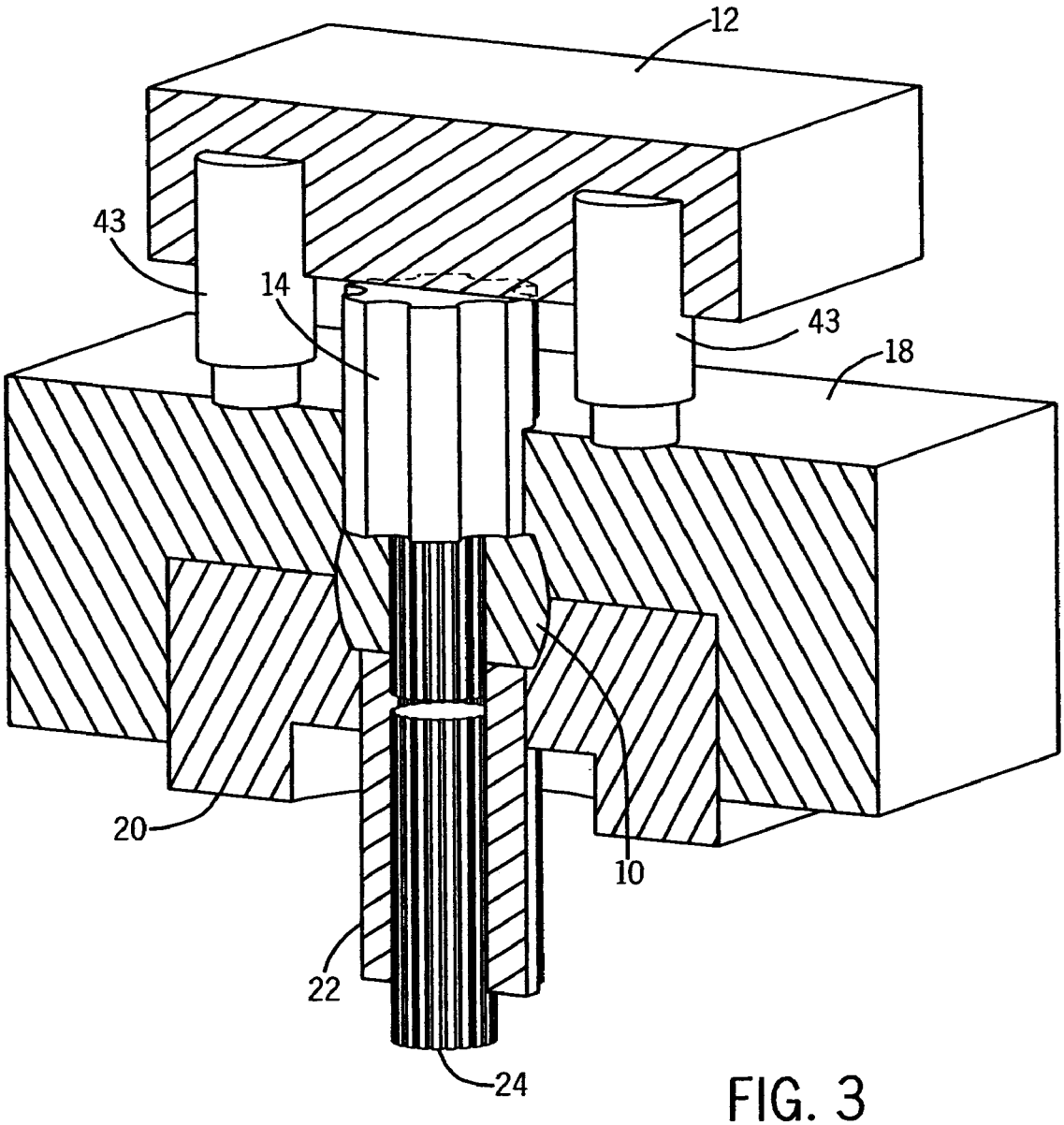
FIG. 3 is a partially cross-sectional view of the method and apparatus of FIG. 1 illustrating the preform being forged.
Figure 4:
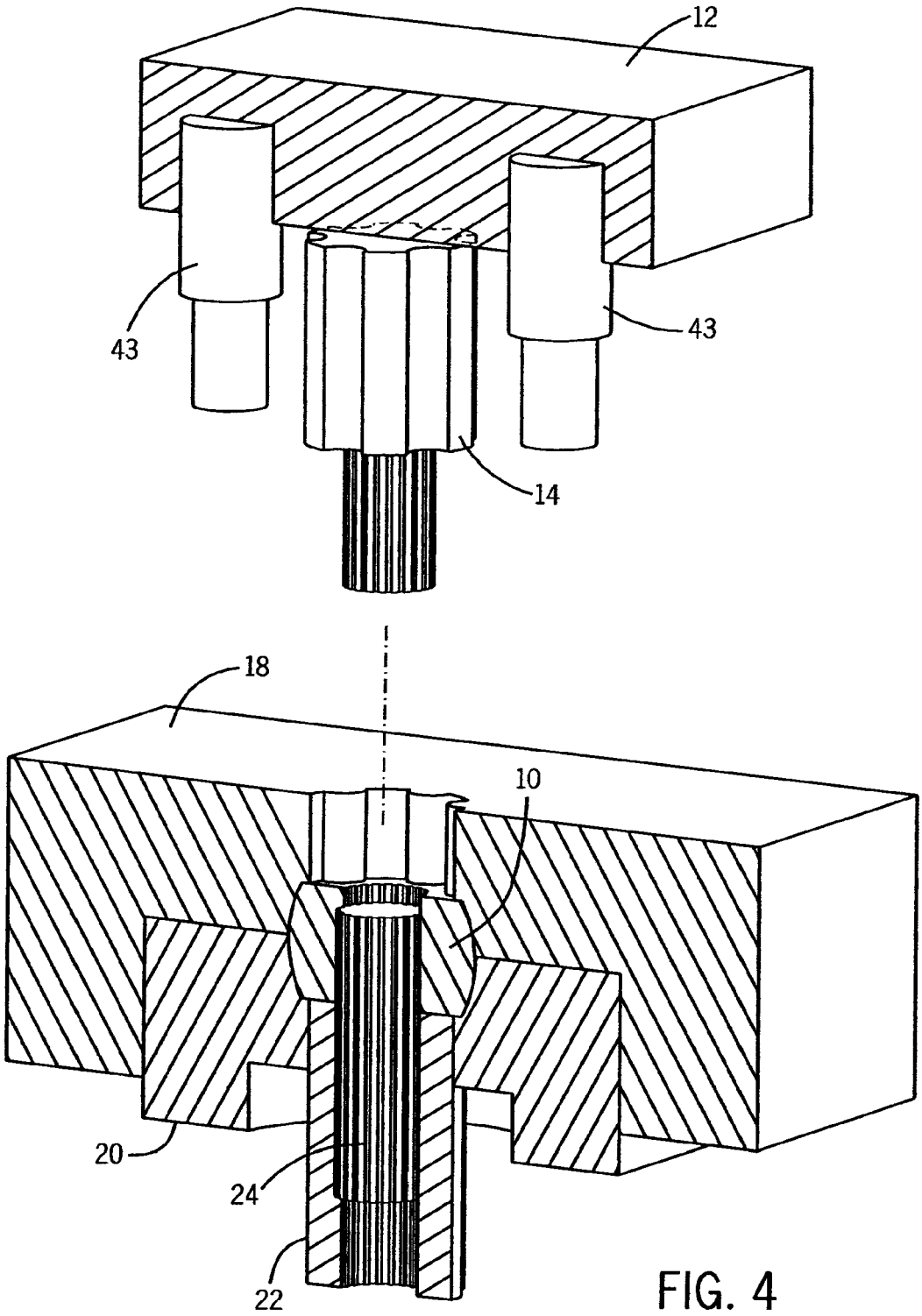
FIG. 4 is a partially cross-sectional view of the method and apparatus of FIG. 1 illustrating the upper ram and punch withdrawn from the die set after the forging operation.
Figure 5:
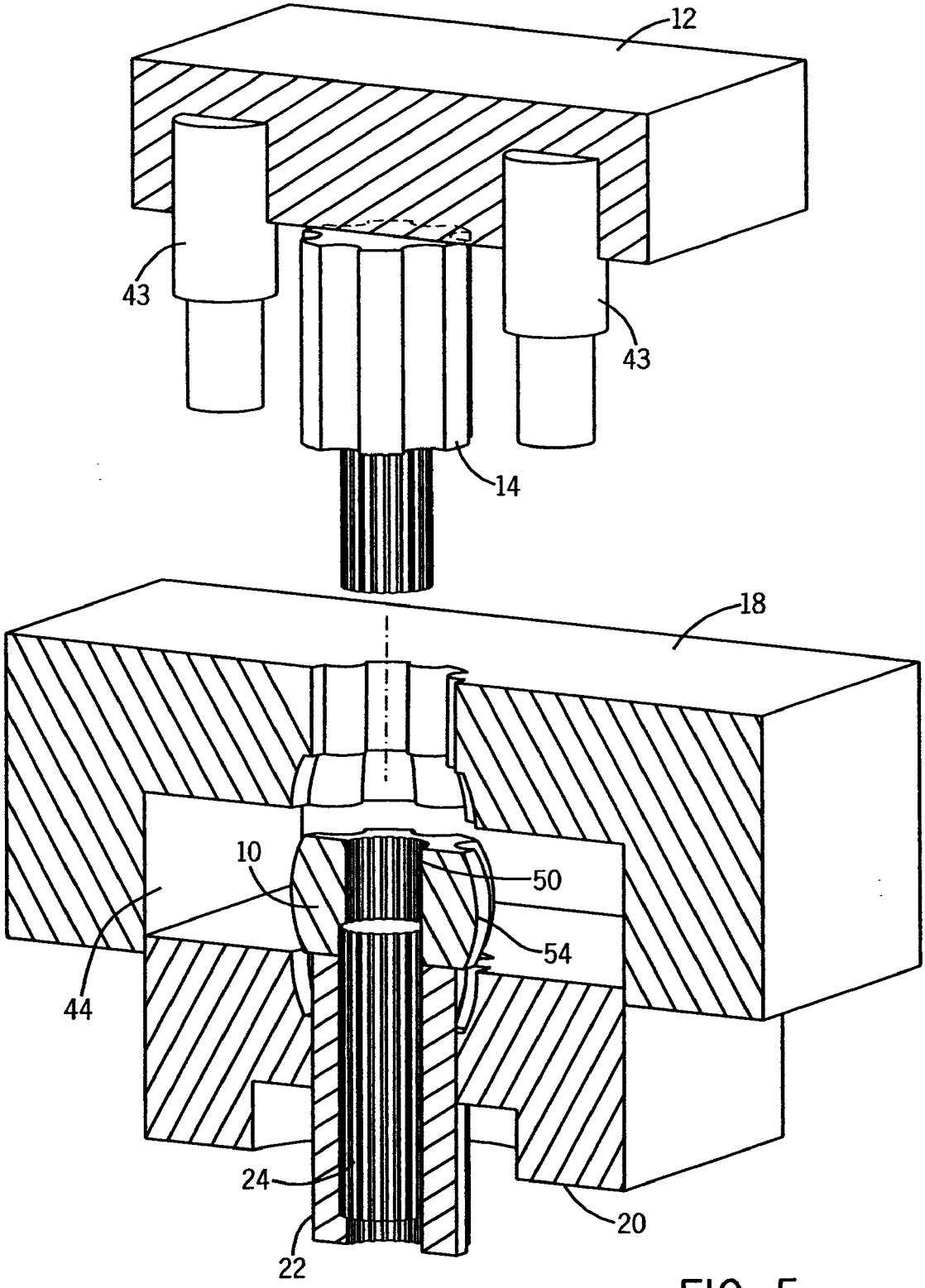
FIG. 5 is a partially cross-sectional view of the method and apparatus of FIG. 1 illustrating the upper die releasing from the lower die, and the lower punch and snag pin ejecting the forging from the lower die.

As shown in FIG. 2, preform 16 is inserted in die set 21 having bottom die 20 and a top die 18, defining a forge form 42 therewithin, when die set 21 is in a closed position wherein top die 18 is contacting bottom die 20. Die set 21 can be held closed using clamps and the like (not shown), and additionally, cylinders 43 can help maintain upper die 18 and lower die 20 in closed contact so that no flash can form on part 10 in the area of the interface between upper die 18 and lower die 20. Preform 16 is compressed (see FIG. 3) in forge form 42 using upper punch 14 and lower punch 22, resulting in a formed part such as forging 10. As shown in FIG. 4, the method according to the present invention can further include the step of raising top die 18 from bottom die 20 thereby creating an interstice 44 between top die 18 and bottom die 20. Formed part 10 is then stripped (see FIG. 5) from bottom die 20 into interstice 44 using lower punch 22 and snag pin 24. The method according to the present invention can further include the step of ejecting formed part 10 from die set 21. Additionally, at least one of bottom die 20 and top die 18 can be heated using a heating fluid (not shown) approximately between 400° F. and 600° F., and more particularly, at 500° F.

The resulting flash free powder metal forging 10 is manufactured from sintered powder metal preform 16, in a forging process according to the present invention, and can be in the form of an inner race of a constant velocity joint as shown particularly in FIG. 7. Forging 10 can include a first end 46, a second end 48 opposed to first end 46, and an inner contour 50 connecting first end 46 and second end 48. Inner contour 50 has a plurality of longitudinal splines 52. An outer contour 54 connects first end 46 and second end 48. Outer contour includes a plurality of curvilinear longitudinal projections 56, where each projection is separated by one of plurality of curvilinear longitudinal depressions 58. Outer contour 54 is absent of flash from the forging process. In the embodiment shown, projections 56 and depressions 58 constitute bearing races of the CVJ inner race which are precision surfaces. Because of the method of manufacture according to the present invention, in which outer contour 54 is absent of flash, the bearing races are correspondingly absent of flash, thereby allowing a direct quenching of part 10 after forging.

A preferred embodiment of the invention has been described in considerable detail. Many modifications and variations to the preferred embodiment described will be apparent to a person of ordinary skill in the art. Therefore, the invention is not be limited to the embodiment described. Accordingly, the scope of the appended claims should not be limited to the description of the embodiments contained herein.

What is claimed is:

1. A method of forming a powder metal forging, the method comprising:

forming a preform including a sintered powder metal composition;

inserting said preform in a die set having a bottom die and a top die which, during insertion of said preform, are in a closed position wherein said top die is contacting said bottom die, said die set defining a forge form therewithin; and compressing said preform in said forge form using an upper punch and a lower punch, said compressing step resulting in a formed part.

2. The method of claim 1, further including the step of raising said top die from said bottom die thereby creating an interstice between said top die and said bottom die.

3. The method of claim 2, further including the step of stripping said formed part from said bottom die into said interstice using said lower punch.

4. The method of claim 3, wherein said lower punch includes a snag pin inserted into an internal feature of said formed part.

5. The method of claim 3, further including the step of ejecting said formed part from said die set.

6. The method of claim 5, the compressing step further including heating the at least one of the top die and the bottom die and the method further including the step of quenching the formed part immediately after the step of ejecting.

7. The method of claim 1, wherein said preform is a noncylindrical preform.

8. The method of claim 7, wherein said noncylindrical preform is comprised of a first end; a second end opposed to said first end; an outer contour connecting said first end and said second end; said outer contour including a plurality of longitudinal projections and a plurality of longitudinal depressions, each of said plurality of longitudinal projections being separated from another of said plurality of longitudinal projections by a corresponding one of said plurality of longitudinal depressions; and an inner contour connecting said first end and said second end, said inner contour having a longitudinal keyway and a plurality of longitudinal splines.

9. The method of claim 7, further including the step of heating at least one of said bottom die and said top die using a heating fluid approximately between 400° F. and 600° F.

10. The method of claim 1, wherein said preform has a density in a range of approximately between 6.85 g/cm$^3$ and 7.4 g/cm$^3$.

11. The method of claim 10, wherein said preform has a density in a range of approximately between 6.85 g/cm$^3$ and 7.0 g/cm$^3$.

12. The method of claim 1, the compressing step further including using cylinders to apply pressure to the die set to maintain closed contact between the top die and bottom die.

13. A method of forming a powder metal forging, the method comprising:

forming a preform including a sintered powder metal composition;

inserting said preform in a die set having a bottom die and a top die, said die set defining a forge form therewithin, said die set being in a closed position wherein said top die is contacting said bottom die;

compressing said preform in said forge form using an upper punch and a lower punch, said compressing step resulting in a formed part;

raising said top die from said bottom die thereby creating an interstice between said top die and said bottom die; and stripping said formed part from said bottom die into said interstice using said lower punch, in which the lower punch includes a snag pin inserted into an internal feature of said formed part.

14. A method of forming a powder metal forging, the method comprising:

forming a preform including a sintered powder metal composition;

inserting said preform in a die set having a bottom die and a top die, said die set defining a forge form therewithin, said die set being in a closed position wherein said top die is contacting said bottom die; and compressing said preform in said forge form using an upper punch and a lower punch, said compressing step resulting in a formed part;

wherein said preform is a noncylindrical preform is comprising:

a first end, a second end opposed to said first end, an outer contour connecting said first end and said second end, said outer contour including a plurality of longitudinal projections and a plurality of longitudinal depressions, each of said plurality of longitudinal projections being separated from another of said plurality of longitudinal projections by a corresponding one of said plurality of longitudinal depressions, and an inner contour connecting said first end and said second end, said inner contour having a longitudinal keyway and a plurality of longitudinal splines.

* * * * *